United States Patent [19]

Tanabe

[11] Patent Number: 4,855,532

[45] Date of Patent: Aug. 8, 1989

[54] WELDING CABLE

[75] Inventor: Katuji Tanabe, Tokyo, Japan

[73] Assignee: Obara Corporation, Tokyo, Japan

[21] Appl. No.: 164,572

[22] Filed: Mar. 7, 1988

[30] Foreign Application Priority Data

Oct. 16, 1987 [JP] Japan ..... 62-157531

[51] Int. Cl.[4] ..... H01B 7/34; H01R 11/16

[52] U.S. Cl. ..... 174/15.7; 174/19; 174/74 R; 219/137.9

[58] Field of Search ..... 174/15 WF, 19, 74 R, 174/75 R; 219/137.9

[56] References Cited

U.S. PATENT DOCUMENTS

| | | | |
|---|---|---|---|
| 2,702,311 | 2/1955 | Botterill et al. | 174/15 WF |
| 2,879,317 | 3/1959 | Wreford | 174/15 WF |
| 3,127,467 | 3/1964 | Toto | 174/19 |
| 3,333,044 | 7/1967 | Toto | 174/15 WF |
| 3,456,064 | 7/1969 | Toto | 174/19 |
| 4,018,976 | 4/1977 | Grove | 174/15 WF X |
| 4,199,653 | 4/1980 | Talley | 174/15 WF |
| 4,487,990 | 12/1984 | Lane et al. | 174/15 WF |

FOREIGN PATENT DOCUMENTS 61-16811 1/1986 Japan .

*Primary Examiner*—Morris H. Nimmo

*Attorney, Agent, or Firm*—Flynn, Thiel, Boutell & Tanis

[57] ABSTRACT

A welding cable comprises an insulating separator, and twisted positive and negative conductors alternately arranged between radial dividing walls defined by the insulating separator. Either the twisted positive or negative conductors are covered by insulating covers near the end of the separator and are extracted from the separator forming a first group of conductors which is pressedly fitted to one terminal contact end. The remaining group of conductors, along with the separator, are pressedly fixed to the other terminal contact end.

4 Claims, 3 Drawing Sheets

WELDING CABLE

BACKGROUND OF THE INVENTION

1. Field of the Invention

The present invention relates to a welding cable comprising positive and negative twisted conductors alternately arranged each after another in multiple division pieces formed by separating radially equally an insulating separator.

2. Prior Art

The inventor of the present invention has proposed the invention as disclosed in Japanese Utility Model Laid-Open Publication No. 61-16811, which is illustrated in FIGS. 6 and 7.

As illustrated in FIG. 6, positive twisted conductors a' and negative twisted conductors b' are alternately arranged one after another. A separator 11 is axially diametrically divided into two parts at an end thereof, namely, a separator part 11*a* and a separator part 11*b*. The twisted conductor a' or b' housed in the separator parts 11*b* or 11*a* as a small number of positive or negative conductors, for instance the number of conductors a' is less than the number of conductors b' in the separator part 11*b* and the number of conductors b' is less than the number of conductors a' in the separator part 11*a*, is covered with an insulating cover 13 and extracted from the separator parts 11*b* or 11*a* (FIG. 7). The extracted insulated conductors a' or b' are collected or put into a group of a large number of positive or negative conductors a' or b'. Each group of the same positive or negative conductors thus collected is pressedly fixed to terminal contact ends 14a, 14b (FIG. 7).

However, the welding cable thus structured is very troublesome in the operation thereof since the twisted conductors in the first separator part shall be replaced by those in the second separator part.

Furthermore, there is a problem that another divided separator becomes an obstacle when one divided separator is pressedly fixed to one of the terminal contact ends so that the twisted conductors may be processed at the state of extreme bending thereof which exceeds the elastic limit of the twisted conductors whereby the welding cable is weaken.

SUMMARY OF THE INVENTION

It is an object of the present invention to provide a welding cable composed of twisted conductors capable of facilitating a welding operation by pressedly fixing the group of twisted conductors of the same electrode to each terminal contact end.

It is a second object of the present invention to provide a welding cable which is resistible to be bent or to the bending strength or prevented from being bent over the elastic limit if bending strength is applied to the welding cable.

In the welding cable comprising twisted positive conductors a, a . . . and negative twisted conductors b, b, each alternately arranged one after another, the positive group of twisted conductors or negative group of twisted conductors is covered near the end of the separator 1 by insulating covers 3 and extracted from the separator 1 to thereby divide the conductors into the positive and negative groups of twisted conductors. One of the groups of the conductors are pressedly fixed to the terminal contact end 4*b* while the other group of the conductors remain in the separator 1 and is pressedly fixed to the other terminal contact end 4a along with the separator 1.

Inasmuch as the twisted conductors extracted from the separator 1 are covered by insulating covers 3, there is no likelihood of generating leakage of current even if they are brought into contact with other twisted conductors. The other conductors which remain in the separator 1 are satisfactorily protected by the separator 1.

When the group of the twisted conductors with the separator 1 are pressedly fixed to the terminal contact end 4*a*, this group of twisted conductors is not restrained by the other twisted conductors as covered by the insulating covers 3. As a result, the group of the twisted conductors not covered by the covers 3 are easily processed. Furthermore, the group of the twisted conductors covered by the insulating covers 3 is also not restrained by the other group of twisted conductors not covered by the covers 3 and the separator 1 so that they can be easily processed.

If bending stress is applied to the cable near the terminal contact end when the cable is used, the cable is resistible to the bending at the terminal contact end.

The above and other objects, features and advantages of the present invention will become more apparent from the following description when taken in conjunction with the accompanying drawings.

PREFERRED EMBODIMENT OF THE INVENTION

Figure 1:
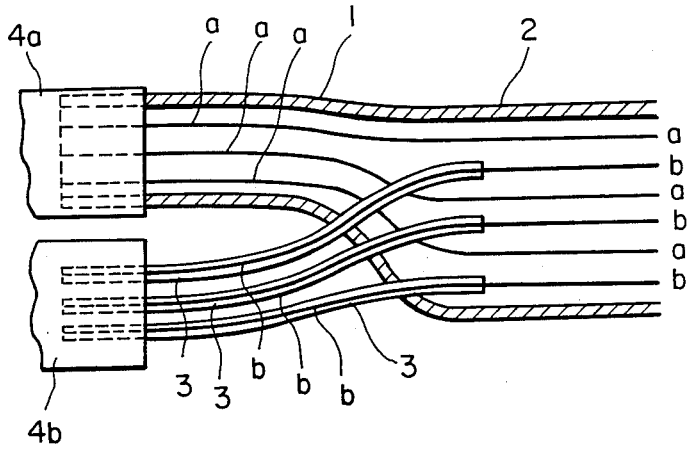
FIG. 1 is a view explaining a principle of connection of a welding cable with terminal contact ends.
Figure 2:
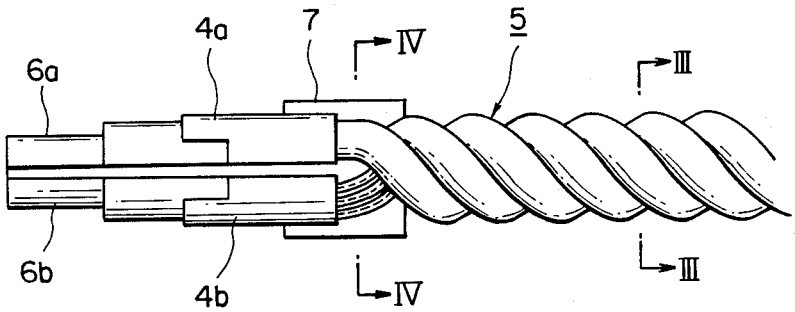
FIG. 2 is a schematic side view embodying the welding cable in FIG. 1.
Figure 3:
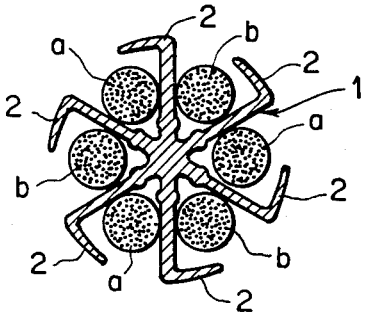
FIG. 3 is a cross-sectional view taken along the line III—III in FIG. 2.
Figure 4:
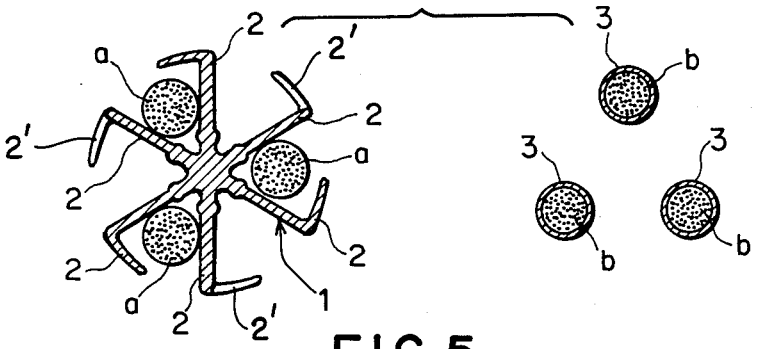
FIG. 4 is a cross-sectional view taken along the line IV—IV in FIG. 2.
Figure 5:
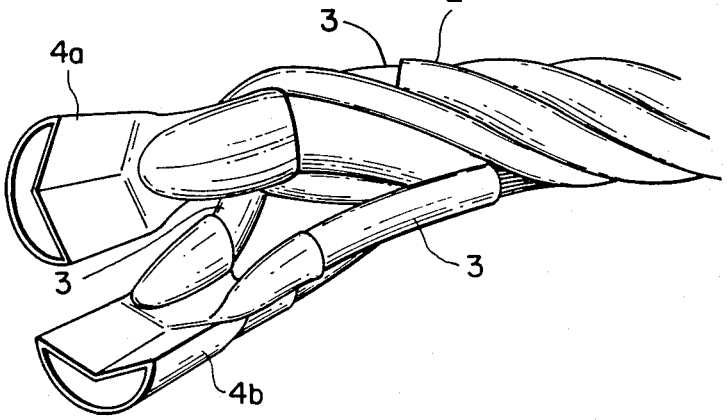
FIG. 5 is a perspective view showing a separator and conductors.
Figure 6:
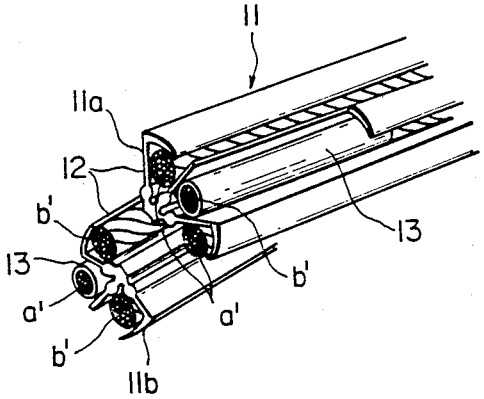
FIG. 6 (PRIOR ART)
FIG. 6 is a perspective view of a conventional welding cable.
Figure 7:
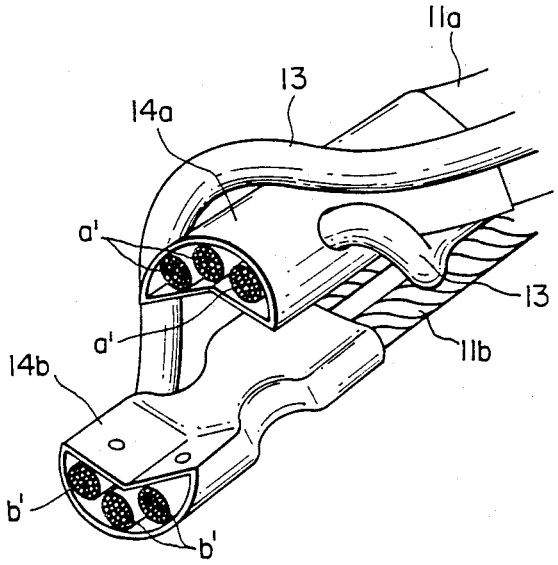
FIG. 7 (PRIOR ART)
FIG. 7 is an exploded perspective view showing the state of connection of the conventional welding cable.

A welding cable according to the present invention will be described with reference to FIGS. 1 to 5.

A welding cable 5 has an insulating separator 1 composed of dividing walls or pieces 2, 2 . . . of L-shape in cross section which divide the separator 1 radially into six parts. Positive twisted conductors a, a, a and the negative twisted conductors b, b, b are alternately arranged in the spaces between the radially-extending division pieces 2, 2 . . . .

At an end of the separator 1, part of the division pieces 2 are cut off so that the conductors b, b, b are easily extracted from the separator 1. For example, the circumferentially extending leg of alternate dividers 2 is removed or cut off, such as indicated at 2' in FIG. 4, so as to enable the conductors b, b, b to be radially outwardly extracted. The extracted twisted conductors b, b, b are all covered by the insulating covers 3, 3, 3.

The twisted conductors a, a, a and in the separator 1 are pressedly fixed to a terminal contact end 4*a*, as schematically shown in FIG. 1, while the conductors a, a, a are satisfactorily protected by the separator 1. The twisted conductors b, b, b covered by the insulating covers 3, 3, 3 are collected in one group and pressedly fixed to a terminal contact end 4*b*.

Designated at 6*a*, 6*b* are respectively terminals of a tranformer and a welder gun (not shown). A collar 7 covers the terminal contact ends 4*a*, 4*b*.

The welding cable is composed of six twisted conductors according to the present invention, but the welding cable may be composed of four twisted conductors, alternately arranged between four division pieces. The division pieces may be T-shaped although it is L-shaped according to the present invention. Furthermore, the separator may be integrated or composed of a plurality of divided parts.

Inasmuch as the welding cable according to the present invention comprises the twisted conductors pressedly fixed to one terminal contact end together with the separator, and the twisted conductors extracted from the separator and pressedly fixed to the other terminal contact end, one group of the twisted conductors is not restrained by the other group of conductors, so that the welding cable is easily processed. Furthermore, inasmuch as it is not necessary to subject the welding cable to extreme bending during the process operation, the conductors do neither exceed the elastic limit nor are fatigued during operation of the welding cable.

Furthermore, the welding cable is able to be used for a long period of time since the welding cable is of desirable bending strength even if the bending is applied near the terminal contact end when the welding cable is used.

Although the invention has been described in its preferred form with a certain degree of particularity, it is to be understood that the present invention is not limited in practical application to the specific embodiment described herein and many changes and variations are possible in the invention without departing from the scope and spirit thereof.

What is claimed is:

1. A welding cable comprising:

an insulating separator having a plurality of circumferentially-spaced radially-extending walls which define a plurality of spaces disposed circumferentially around the separator;

a group of twisted positive conductors and a group of twisted negative conductors, said positive and negative conductors being circumferentially alternatively arranged in said spaces;

each of the conductors of one said group, in the vicinity near but spaced from the end of said separator, being extracted radially outwardly from said separator and covered by an insulating cover, the conductors of the remaining group being maintained within the respective spaces of the separator;

a first terminal contact fixedly pressed to each of the conductors of said one group; and a second terminal contact fixedly pressed to each of the conductors of the remaining group and to said separator;

whereby said terminals are adapted for connection with terminals of a transformer and a welding gun.

2. A welding cable according to claim 1, wherein said radially-extending walls include a main wall portion which projects radially outwardly for circumferentially separating adjacent spaces and which adjacent its radially outer end is joined to a peripheral wall portion which extends circumferentially for at least partially closing off the circumferential periphery of said space, said peripheral wall portions associated with the spaces which confine the conductors of said one group, in the vicinity of the end of the separator, being removed to permit the conductors of said one group to be extracted radially outwardly from the separator.

3. A welding cable according to claim 2, wherein the separator is divided into six spaces, and wherein each group includes three said conductors.

4. A welding cable according to claim 3, wherein the negative conductors are extracted radially from the separator and define said one group.

* * * * *